United States Patent [19]

Yamamoto et al.

[11] 4,436,179

[45] Mar. 13, 1984

[54] NOISE CONTROL APPARATUS

[75] Inventors: Tsuyoshi Yamamoto; Norihisa Taniguchi, both of Tokyo; Kazuyoshi Iida, Yokohama; Yoshikazu Kondo, Tokyo, all of Japan

[73] Assignees: Japanese National Railways; Bridgestone Tire Company Limited, both of Tokyo, Japan

[21] Appl. No.: 335,617

[22] Filed: Dec. 30, 1981

[30] Foreign Application Priority Data

Jan. 9, 1981 [JP] Japan ..... 56-1156

[51] Int. Cl.[3] ..... G10K 11/00

[52] U.S. Cl. ..... 181/210; 181/286; 181/288; 104/124; 105/452

[58] Field of Search ..... 181/210, 224, 284, 286, 181/288; 105/452; 104/1 R, 124

[56] References Cited

U.S. PATENT DOCUMENTS

| | | | |
|---|---|---|---|
| 3,080,937 | 3/1963 | Garbell | 181/210 |
| 4,069,768 | 1/1978 | Matsumoto et al. | 181/210 X |
| 4,158,401 | 6/1979 | Matsumoto et al. | 181/210 |

FOREIGN PATENT DOCUMENTS 54-2006 2/1979 Japan .

*Primary Examiner*—Benjamin R. Fuller
*Attorney, Agent, or Firm*—Parkhurst & Oliff

[57] ABSTRACT

A noise control apparatus for reducing a sound volume of a noise propagating from a noise source such as a railroad includes a sound arresting wall placed apart from the noise source. Means for shifting in phase and refracting the acoustic wave of the noise is disposed at substantially the top of the noise arresting wall. The above means, for example, has a plurality of passageways extending substantially along the propagating direction of the acoustic wave of the noise and the length of the passageways varies. Through the above means, a part of the acoustic wave from the noise source is refracted and the phase thereof is shifted to be a refracted propagating sound, which thereafter interferes with the other part of the acoustic wave directly from the noise source to thereby reduce a sound volume to a great extent.

7 Claims, 7 Drawing Figures

NOISE CONTROL APPARATUS

BACKGROUND OF THE INVENTION

1. Field of the Invention

This invention relates to a noise control apparatus, and particularly to a noise control apparatus capable of more effectively accomplishing a sound volume reduction by use of a sound arresting wall and others.

2. Description of the Prior Art

It is well known that sound arresting walls and the like for reducing sound volumes have been developed as the interest in various noise nuisances has highly grown. Although it is said that noise source countermeasure which to deal with the noise source is a matter calling for prior settlement in the field of overcoming the noise nuisances, the noise source countermeasure is limited and is difficult to apply in many cases. As a common sound arresting method, there has been adopted a method of isolating the propagation of sounds by the provision of an obstacle such as a sound arresting wall between a noise source and a sound receiving point, or a method of completely enclosing the noise source for isolation. However, it is natural that, in the former, the sound arresting wall is limited in sound arresting effect, and, the latter is disadvantageous in that, because of dealing with the other factors such as heat and exhaust gases, construction thereof becomes complex, and sometimes, it becomes impracticable.

For specific example, as a measure to counter a train noise nuisances generated by the travel of railroad vehicles such as a bullet train at present, sound arresting walls are principally adopted. Nevertheless, due to the fact that the noise is diffracted over the sound arresting walls, this measure is limited in sound volume reducing effect, and particularly, such a result has been proven that, in the district where the noise source is open to the eye, the effect by the sound arresting walls is hardly achieved. To overcome this disadvantage, it is conceivable to adopt a shelter system in which the total length of the railroad is completely enclosed as described above, which, however, is disadvantageous in that this system is almost impracticable in consideration of a so-called sunshin right, costs, ventilation and psychological reactions on the part of passengers.

The abovedescribed problems are similarly true of a measure to counter automobile travel noises on highways and mechanical noises generated in factories.

SUMMARY OF THE INVENTION

The present invention has as its object to avoid the abovedescribed disadvantages, and contemplates to improve the effect by the sound arresting wall of the prior art. The technical gist of the present invention resides in a noise control apparatus characterized in that a sound arresting wall spaced apart from a noise source has, at substantially the top portion thereof, a hollow member having a plurality of hollow passageways being different in their lengths from one another. The hollow member allows part of the noise propagating from the noise source to pass through the hollow passageways for being refracted and shifted in phase to be a refracted propagating sound. The sound directly propagating from the noise source is interfered with the refracted propagating sound through the passageways, thereby forming a sound volume reducing zone where the sound volume of the noise is reduced to a great extent.

DESCRIPTION OF THE PREFERRED EMBODIMENTS

Description will hereunder be given of embodiments of the noise control apparatus according to the present invention with reference to the drawings.

Figure 1:
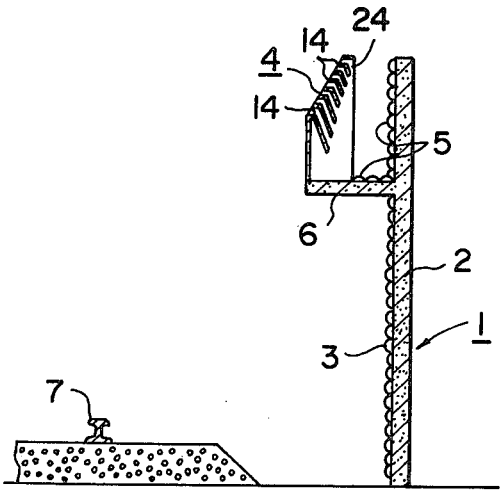
FIG. 1 is an explanatory view showing an embodiment, in which the noise control apparatus according to the present invention is applied to a railroad.

FIG. 1 shows the noise control apparatus according to the present invention, applied for the noise generated by the railroad. Designated at 1 is a sound arresting wall comprising a sound barrier board 2 for isolating the noise and a sound absorbing member secured on the surface of the sound barrier board 2.

The sound arresting wall 1 is disposed at a position spaced apart from the rails 7 functioning as a noise source. Here, if only the sound arresting wall 1 is provided, a noise generated by the noise source is diffracted around the upper end of the sound arresting wall 1 and reaches a sound receiving point. Due to the diffraction of the noise effected in this case, the noise is reduced in its volume to some extent. However, since the noise is not completely isolated and is transmitted over the sound arresting wall, the sound reducing effect is limited.

Now, according to the present invention, a noise control hollow member 4 is, for example, mounted on a mount 6 provided at the upper inner portion of the sound arresting wall 1 as shown in the drawings. For instance, the noise control hollow member 4 has a plurality of passageways different in their lengths from one another as described in Japanese Patent Application Publication No. 2006/79. More specifically, the noise hollow member 4 in this embodiment has a plurality of bent plates 14 between a pair of side wall members 24. The bent plates 14 are disposed vertically with an equal interval therebetween, respectively, and front edges thereof are aligned in such a manner that the line drawn through the front edges is diagonal deceding from the noise source as it goes upper. Each length of the bent plates 14 varies in a constant rate, so that the upper plate is shorter than the lower plate. Therefore, a plurality of passageways are formed between the plates, which passageways are directed in a horizontal direction at the forward end thereof, and then turned downward. Namely the passageways at the forward ends thereof are substantially directed toward the noise source.

Therefore, the passageways allow part of the noise generated by the noise source to pass therethrough, whereby the noise is shifted in phase and turned into a refracted propagating sound. Due to a difference in phase between the refracted propagating sound and the directly propagating sound not having passed through the passageways and passing over the hollow member 4, a destructive interfering phenomenon takes place upwardly and rearwardly of the hollow member 4, thereby forming a sound volume reducing zone. The passageways may be designed such that their lengths are differentiated to increase the shift in phase between the refracted propagating sound and the directly propagating sound, thereby enlarging the sound volume reducing zone.

As a consequence, as shown in FIG. 1, the refracted propagating sound having passed through the hollow member 4 is absorbed by sound absorbing materials or member 5 secured onto the surface of the sound arresting wall 1, whereby the effect of the sound volume reduction by the sound arresting wall 1 and the effect of the sound volume reducing zone by way of the hollow member are combined, thereby enabling to accomplish a high combined sound reducing effect.

Figure 2:
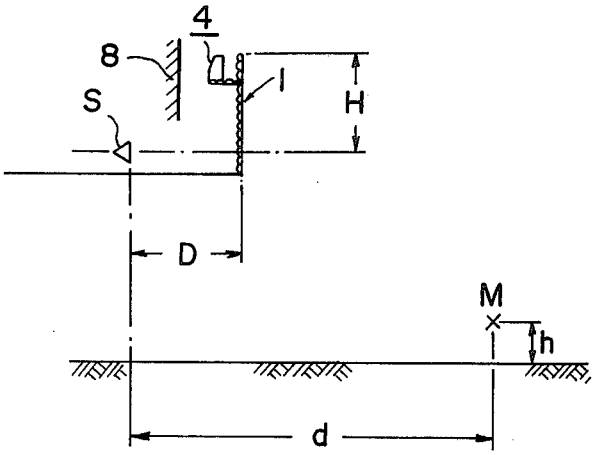
FIG. 2 is an explanatory view showing the laboratory equipment used in measuring the sound volume reducing effect.

FIG. 2 shows a laboratory equipment indicating the sound volume reducing effect of the noise control apparatus according to the present invention. The sound arresting wall 1 has a height of 2.8 m above a sound source speaker S and is spaced apart with a horizontal distance D of 2.7 m from the speaker S. Designated at 8 is a reflector board in imitation of a side plate of a train wagon. A sound receiving point M is disposed at a position spaced apart with a distance d of 25 m and has a height of 1.2 m above the ground.

Figure 3:
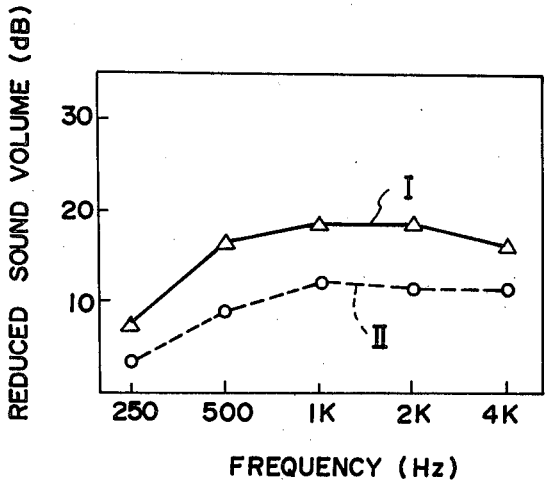
FIG. 3 is a graphic chart showing the sound volume reducing effect as the results of the experiments.

FIG. 3 shows the results of experiments using the laboratory equipment described above, the noise control apparatus according to the present invention is compared with the conventional apparatus having only the sound arresting wall. In FIG. 3, designated at I is a curve indicating the sound volume reducing effect obtained by the noise control apparatus according to the present invention, and II a curve indicating the sound volume reducing effect obtained by the conventional apparatus. As apparent from the graphic chart, the sound volume reduced by the sound arresting wall only is about 9–12 dB in 500–1 KHz which are prevalent frequencies of the railroad noises, whereas the sound volume reduced by the noise control apparatus according to the present invention is 17–19 dB, thereby proving the high sound volume reducing effect obtained by the latter. Consequently, in the use of the noise control apparatus according to the present invention, it is expectable to accomplish a sound volume reduction by 7–8 dB higher than that in the use of the sound arresting wall only.

In this embodiment, the mount 6 is provided at a position slightly lower than the upper most end of the sound arresting wall 1 and the hollow member 4 is mounted on the mount 6 so that the upper portion of the sound arresting wall 1 functions to isolate the refracted propagating sound downward from the hollow member 4. However, the provision of the hollow member 4 need not necessarily be limited to this example.

Figure 4:
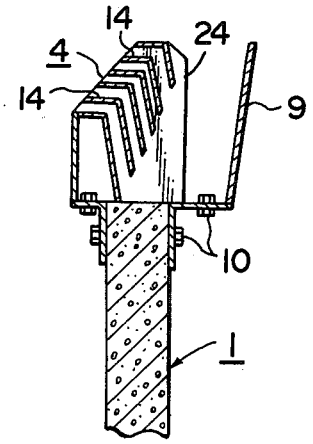
FIGS. 4 through 7 are explanatory views showing other embodiments of the present invention, respectively.

When the sound arresting wall is low in its height, the hollow member 4 is provided at the top end of the sound arresting wall 1 as shown in FIG. 4. In FIG. 4, designated at 9 is a sound insulating board or member for isolating the refracted propagating sound downward, and 10 fasteners for fixing the hollow member 4 and sound barrier board 9.

Figure 5:
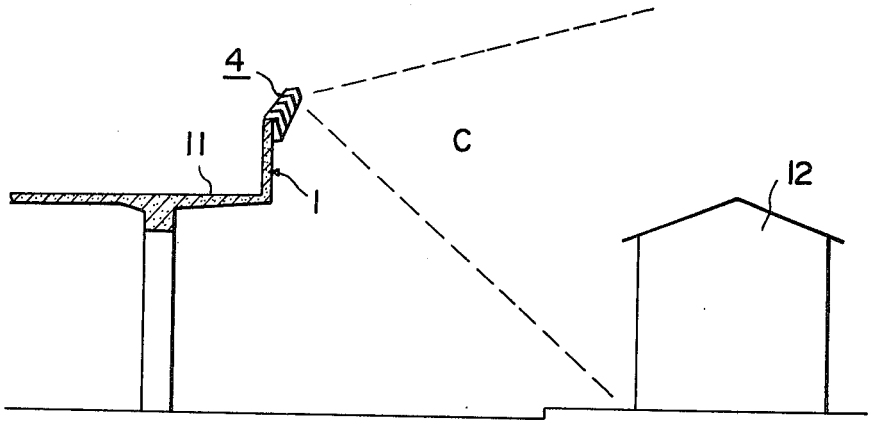

If the refracted propagating sound propagating downward from the hollow member do not matter, e.g., the sound arresting wall is far apart from the sound receiving position and the like, necessity for the sound barrier board for isolating the refracted propagating sound is eliminated as shown in FIG. 5.

Figure 6:
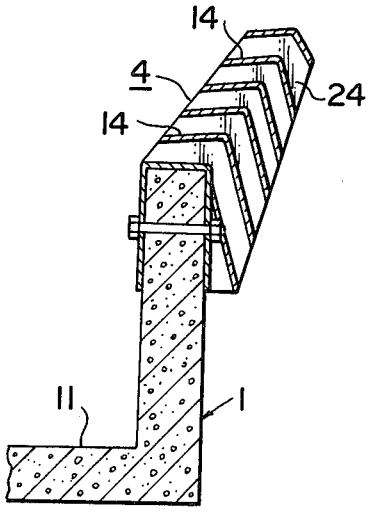
Figure 7:
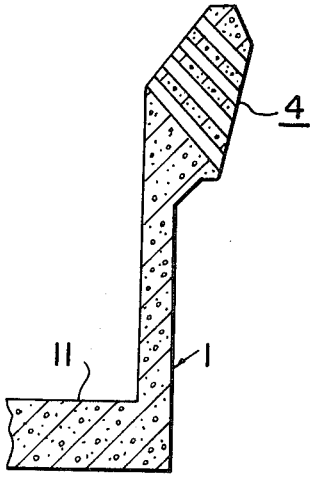

More specifically, when an elevated bridge 11 is far apart from the sound receiving position 12 as shown in FIG. 5, or the sound receiving position 12 is included in the sound volume reducing zone (indicated by C in FIG. 5), necessity for isolating the refracted propagating sound is eliminated. FIGS. 6 and 7 show examples of provision of the hollow member 4 at the upper end portion of the sound arresting wall in the cases described above. FIG. 6 shows the hollow member 4 provided at the top end portion of the sound arresting wall 1, in which case the hollow member 4 is secured to the sound arresting wall 1 such that a framework provided at the lower portion of the hollow member 4 is superposed on the sound arresting wall 1, and fastened to the latter by means of bolts. In FIGS. 5 and 6, the side wall members 24 of the hollow member 4 are formed in such a manner that the front and back edges thereof are aligned with the lines drawn through the front and back ends of the bent plates 14 respectively. FIG. 7 shows an example, in which the hollow member is integrally formed on the top end of the sound arresting wall 1 then the sound arresting wall is formed. In addition, materials for forming the hollow member used in the noise control apparatus according to the present invention, are preferrable to be materials light in weight, durable and having a required mechanical strength and rigidity, including plates made of iron, aluminum, asbestos cement, GRC and the like.

As has been described hereinabove, the noise control apparatus according to the present invention can accomplish a high sound volume reducing effect through the combination of the sound volume reducing effect by the sound arresting wall disposed at the position apart from the noise source with the sound reducing effect by the hollow member. Particularly, in the case of the railroad, the provision of the noise control apparatus at a position apart from the rails offers a high advantage in the field of safety running operation and maintenance.

What is claimed is:

1. A noise control apparatus for reducing sound volume of noise propagating from a noise source, comprising:

a sound arresting wall separate from the noise source; and means for shifting in phase and refracting the acoustic wave of the noise to provide a refracted propagating acoustic wave, said means being disposed at substantially the top of said sound arresting wall, said means being hollow and further comprising bent plates vertically disposed within said means, said bent plates having an equal interval therebetween and having front edges aligned in such a manner that a line drawn through the front edges diagonally descends and intersects with said noise source, whereby said refracted propagating acoustic wave interferes with said acoustic wave directly propagating from the noise source and diffracting over said sound arresting wall.

2. A noise control apparatus as set forth in claim 1, wherein said sound arresting wall comprises a sound absorbing member on the inner side thereof facing the noise source.

3. A noise control apparatus as set forth in claim 1, further comprising a sound insulating member placed behind said means to isolate said refracted propagating sound downwardly propagating from said means.

4. A noise control apparatus as set forth in claim 1 or 3 wherein said means is disposed on the top of said sound arresting wall.

5. A noise control apparatus as set forth in claim 1 or 3 wherein said means is disposed at inner upper side of said sound arresting wall, and said sound insulating member is the upper portion of said sound arresting wall.

6. A noise control apparatus as set forth in claim 1, wherein said means is integrally formed on said sound arresting wall.

7. A noise control apparatus as set forth in claim 1, wherein said sound arresting wall placed about 2.7 m apart from the noise source and extending about 2.8 m from the noise source.

* * * * *